US007425206B2

(12) United States Patent
Byrne et al.

(10) Patent No.: US 7,425,206 B2
(45) Date of Patent: Sep. 16, 2008

(54) INTRAVENOUS PROTECTOR WRAP WITH ENTERTAINMENT

(76) Inventors: Kathleen Byrne, 41 Fairmount St., Lowell, MA (US) 01852; Maureen Doherty, 169 Fairmount St., Lowell, MA (US) 01852

( * ) Notice: Subject to any disclaimer, the term of this patent is extended or adjusted under 35 U.S.C. 154(b) by 500 days.

(21) Appl. No.: 10/027,228

(22) Filed: Dec. 20, 2001

(65) Prior Publication Data

US 2004/0205875 A1 Oct. 21, 2004

Related U.S. Application Data

(60) Provisional application No. 60/257,064, filed on Dec. 20, 2000.

(51) Int. Cl.
*A61M 5/32* (2006.01)

(52) U.S. Cl. ..... 604/174; D24/127; D24/128; 602/21; 602/61

(58) Field of Classification Search ..... 604/174, 604/180; 128/877, DIG. 6, DIG. 26; D24/108, D24/127, 130; D21/576, 621; 602/20, 21, 602/60–62

See application file for complete search history.

(56) References Cited

U.S. PATENT DOCUMENTS

| | | | | |
|---|---|---|---|---|
| 3,761,069 | A | 9/1973 | Moore | |
| 4,527,566 | A | 7/1985 | Abare | |
| 4,531,942 | A * | 7/1985 | Turner | 604/180 |
| 4,671,787 | A * | 6/1987 | Widman | 604/179 |
| 4,799,923 | A | 1/1989 | Campbell | |
| 5,076,289 | A | 12/1991 | Darling | |
| 5,148,804 | A | 9/1992 | Hill et al. | |
| D335,927 | S | 5/1993 | Burgio et al. | |
| 5,304,216 | A | 4/1994 | Wallace | |
| 5,378,225 | A | 1/1995 | Chatman, Jr. et al. | |
| 5,395,399 | A | 3/1995 | Rosenwald | |
| 5,413,120 | A | 5/1995 | Grant | |
| 5,624,391 | A | 4/1997 | Fan et al. | |
| 5,649,901 | A * | 7/1997 | DiPietro et al. | 602/26 |
| 5,664,581 | A | 9/1997 | Ashley | |
| 5,695,453 | A * | 12/1997 | Neal | 602/6 |
| 5,827,207 | A | 10/1998 | MacMorran | |
| 5,873,130 | A * | 2/1999 | Lafferty | 2/16 |
| 5,968,536 | A * | 10/1999 | Godfrey | 424/402 |
| 6,322,539 | B1 * | 11/2001 | Cook | 604/174 |
| 7,077,142 | B1 * | 7/2006 | Barany et al. | 128/877 |

* cited by examiner

*Primary Examiner*—Patricia Bianco
*Assistant Examiner*—Camtu Nguyen
(74) *Attorney, Agent, or Firm*—John H. Pearson, Jr., Esq.; Walter F. Dawson, Esq.; Pearson & Pearson, LLP.

(57) ABSTRACT

A wrap for covering and protecting an intravenous site on a hand of a patient having an entertainment component such as a doll or puppet for children. The wrap comprises doll arm holes, a thumb hole and a plurality of fastening strips strategically located on both sides of the wrap for securing the wrap around the entertainment device and the intravenous site on the patient's hand. An alternate embodiment comprises a wrap with an entertainment device for protecting an intravenous site on the hand of a baby. The wrap may also be used on a foot and/or at the area of the antecubital fossa (bend of the arm) or the forearm by disregarding the finger placement holes.

3 Claims, 14 Drawing Sheets

INTRAVENOUS PROTECTOR WRAP WITH ENTERTAINMENT

This is a nonprovisional patent application claiming priority of provisional patent application Ser. No. 60/257,064 filed Dec. 20, 2000.

BACKGROUND OF THE INVENTION

1. Field of the Invention

This invention relates generally to providing a comfortable protective covering on the hand or the limb of a patient having an intravenous site, and in particular, to providing a protective wrap comprising an entertainment device such as a doll or puppet for the pediatric and geriatric population.

2. Description of Related Art

Many hospital and home care patients require an intravenous (IV) fluid to be injected into their body and often a needle is inserted into a vein either on the back of the hand or into the antecubital space at the bend of the elbow and occasionally on the feet. The more conventional approach is to heavily tape the needle, having a medical tube attached thereto, to the patient's skin and/or sometimes a stiff board may be used along with the tape to assist in securing the puncturing needle and medical tube to the hand, arm or foot.

Sometimes layers of tape are required to secure the intravenous tubing to the limb of the patient. However, a patient may receive intravenous fluid over a period of hours or days and tape may lose their binding force as the patient perspires or liquids spill in the area of the needle or taping. This requires untaping and retaping the device to the patient's skin to maintain the security of the intravenous placement, causing skin irritation and pain from the removal of the tape as well as frequent, accidental dislodgement of the intravenous catheter requiring unnecessary painful reinsertion. Because of this unpleasant necessity for securement, most caretakers avoid proper inspection care and management of the intravenous site, thereby increasing the patient's risk for infection and malfunction of the IV. There have been many devices proposed to protect the intravenous puncture, needle and tubing, and several of these are described hereinafter.

Patients, particularly pediatric and geriatric patients who require IV therapy also require more astute observation to protect the IV site from harm. A device that both protects the IV site and also provides creative entertainment in a user friendly manner for a child like mind will discourage the patient's curious need to disrupt the placement of the IV because they accept the device more readily. A device that is limited to stiffly immobilizing the limb is not adequate or safe.

U.S. Pat. No. 3,761,069, issued Sep. 25, 1973, to Arthur B. Moore, discloses a buffer coil installed helically around a support rod for an IV feeding bottle hanging from an arm affixed to an upper end of the support rod. The coil comprises a coiled steel spring surrounded by flexible polyurethane foam and acts as a shock absorber for a swinging IV bottle. This patent further discloses the notion of twisting or forming the buffer coil into some interesting character or variety of shapes to add an appealing toy or novelty item.

U.S. Pat. No. 5,076,289, issued Dec. 31, 1991, to Harold E. Darling discloses a medical tube securing device such as for gastrostomy tubes which project from a person's body. The device wraps around a person's body and comprises an elongated band, having first and second ends, top and bottom edges, and fastening strips. The band carries a pouch which opens having a front or flap portion. Fastening strips secure the front and back portions of pouch. The end of a tube is pulled through the opening.

U.S. Pat. No. DES. 335,927, issued May 25, 1993, to Paul A. Burgio et al., discloses an otoscope having an animal such as a bear disposed on top for entertaining children.

U.S. Pat. No. 5,413,120, issued May 9, 1995, to Michael L. Grant, discloses an IV injection shield assembly comprising a base and an overlying transparent shield or cover. A layer of self-adhesive fabric material is bonded to the bottom surface of the base. A plurality of strap means extend through slots transversely of the base for securing a patient's limb to the base. The tubing is taped to the exterior surface of the shield, and a catheter is inserted into the back of a patient's hand via an access opening in the shield.

U.S. Pat. No. 5,664,581, issued Sep. 9, 1997, to John P. Ashley, discloses an IV tubing secure strap for securing and restraining IV tubing to prevent dislodgement of a venipuncture device. The strap comprises bridge hinge, secure tab, a strap section preferably comprising a bed or base and overwrap. The underlying surface is preferably loop material. The overlying surface of the overwrap is preferably a relatively smooth finish which may be screened with artwork. Attached to the bed toward the distal end of slot is the bridge hinge. Distal end of bridge hinge is sonically welded to bed. The proximal end of bridge hinge is attached to the overside of secure tab.

SUMMARY OF THE INVENTION

Accordingly, it is therefore an object of the present invention to provide a noninvasive, comfortable, intravenous site protector without using excessive tape.

It is another object of the invention to provide an IV site wrap that facilitates ease of removing the wrap to observe the IV site, replacing the wrap easily without stress to the patient, and improving compliance of a staff/caregiver for inspecting the IV site.

It is another object of the invention to provide an intravenous site wrap which includes an entertainment device for the patient.

It is a further object of the invention to provide a soft doll within the intravenous wrap to safely, comfortably, immobilize the IV site limb in proper body alignment, which also provides for entertainment of the patient.

It is yet another object of the invention to provide a wrap that is less invasive and more comfortable while maintaining a patient's privacy.

It is still another object of the invention to provide an intravenous site wrap that maintains a patient's skin integrity, natural body alignment and proper range of motion.

It is another object of this invention to provide an intravenous site wrap with an entertainment device including a miniature doll suitable for a baby's hand, limb or foot.

These and other objects are accomplished by a protective wrap comprising a rear side of the wrap which comprises a first area of fastening material adjacent to a first end of the wrap, a plurality of first openings adjacent to the first area of fastening material for inserting a portion of an object through at least one of the first openings, a second area of fastening material positioned on the wrap approximately midway between the first end and a second end of the rear side of the wrap, a plurality of second openings vertically arranged adjacent to the second area of fastening material and spaced apart from the second end of the wrap, a front side of the wrap comprises a third area of fastening material positioned adjacent to the second end, and a fourth area of fastening material on the front side of the wrap and positioned approximately midway between the second area of fastening material on the rear side of the wrap and the plurality of first openings. The wrap comprises a rectangularly shaped flexible material having the rear side, the front side, the first end, the second end, a top edge and a bottom edge. The first area of fastening material on the rear side comprises hook material. The plurality of first openings adjacent to the first area of fastening material comprises elongated horizontal openings. The second area of fastening material on the rear side comprises fibrous loop material for fastening to hook material. The vertically arranged plurality of second openings comprises elongated vertical openings. The fourth area of fastening material on the front side comprises fibrous loop material for fastening to hook material. The wrap comprises at least one pocket on the wrap for receiving a stiffening insert. THe wrap is flexible for wrapping around a hand of a person having an intravenous site including an entertainment device which is positioned in front of the hand. The wrap comprises an entertainment device positioned on the plurality of first openings having an extension portion passing through at least one of the plurality of first openings. The entertainment device comprises a doll, a game, or an electronic device.

The objects are further accomplished by a protective wrap for covering an intravenous site on a person including an entertainment device comprising a rear side of the wrap which comprises a first area for fastening material adjacent to a first end, a plurality of first openings adjacent to the first area of fastening material for inserting a portion of an entertainment device through at least one of the first openings, the entertainment device being positioned on the rear side over the plurality of first openings, a second area of fastening material positioned on the wrap approximately midway between the first end and a second end of the rear side of the wrap, a plurality of second openings vertically arranged adjacent to the second area of fastening material and spaced apart from the second end of the wrap, one of the plurality of second openings capable of receiving a thumb of the person, and a portion of the second area of fastening material adjacent to the plurality of vertically arranged second openings provides for receiving a palm of a hand of the person to rest thereon, a front side of the wrap comprises a third area of fastening material adjacent to the second end, the front side of the wrap comprises a fourth area of fastening material positioned approximately midway between the second area of fastening material on the rear side of the wrap and the plurality of the first openings, the second end of the wrap being capable of being folded over a back portion of the hand and the third area of fastening material on the front side of the protective wrap attaches to the second area of fastening material on the rear side of the wrap, the second end of the wrap being capable of being turned 360 degrees in the direction of the first end whereby the fourth area of fastening material on the front side of the wrap faces outwardly away from the hand, and the first end of the wrap having the first area of fastening material on the rear side of the wrap attaches to the outwardly facing fourth area of fastening material on the front side of the wrap. The entertainment device comprises a doll, the arms of the doll extending through a pair of the plurality of first openings. The wrap includes a fingerless glove for covering the hand having the intravenous site prior to being wrapped by the protective wrap.

The objects are further accomplished by a protective wrap for a hand of a baby with an intravenous site and having an entertainment device comprising a rear side of the wrap which comprises at least one closure tab extending from a first end of the wrap and at least one receiving tab extending from a second end of the wrap, a plurality of openings positioned in a central area of the wrap to receive a thumb of the baby, an elongated passage positioned adjacent to and parallel to a top edge of the wrap above the plurality of first openings, a flap extending from a central portion of the top edge of the wrap for folding over a back side of the hand of the baby, the flap having holes for receiving fingers of the baby, and a front side of the protective wrap comprises a first fastening material positioned between the plurality of openings and the first end and the front side comprises a second fastening material on the at least one closure tab. The at least one closure tab comprises an opening for insertion of the receiving tab for securely closing the wrap around the hand of a baby. The second fastening material comprises a fibrous loop material attached to the at least one closure tab on the front side of the wrap. The first fastening material on the front side of the protective wrap extends from approximately a top edge of the wrap to approximately a bottom edge of the wrap. The first fastening material comprises a hook material. The plurality of openings positioned in a central area of the wrap provides for a portion of the entertainment device to extend therethrough. The entertainment device comprises a doll, the head of the doll extending through the elongated passage from the rear side of the wrap and the arms of the doll extending through a pair of the plurality of openings. The flap folds over the hand of the baby, the hand resting on the doll, and the fingers of the baby extend into the holes of the flap with the thumb of the hand extending into one of the plurality of openings. The closure tab extends into an opening of the receiving tab, the closure tab being pulled back to enable the second fastening material to attach to the first fastening material thereby securing the protective wrap.

Additional objects, features and advantages of the invention will become apparent to those skilled in the art upon consideration of the following detailed description of the preferred embodiment exemplifying the best mode of carrying out the invention as presently perceived.

BRIEF DESCRIPTION OF THE DRAWINGS

The appended claims particularly point out and distinctly claim the subject matter of this invention. The various objects, advantages and novel features of this invention will be more fully apparent from a reading of the following detailed description in conjunction with the accompanying drawings in which like reference numerals refer to like parts, and in which:

Description of Illustrative Embodiment

Figure 1:
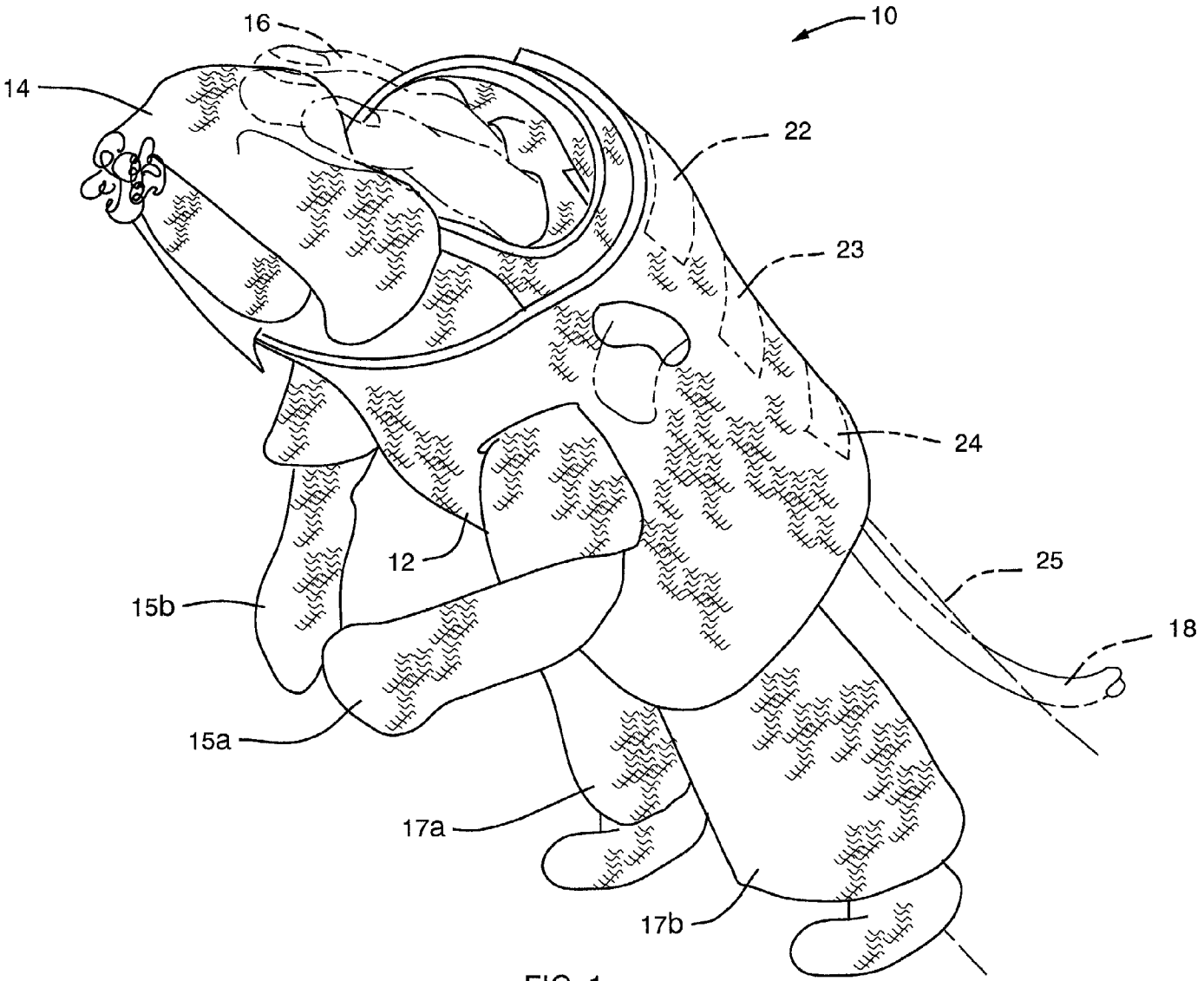
FIG. 1 is a perspective view of a preferred embodiment of the invention of an intravenous protector wrap wrapped around a wearer's IV hand or limb including an entertainment doll.

Referring to FIG. 1, a perspective view of a preferred embodiment of the invention of an intravenous (IV) site protective assembly 10 comprising a wrap 12 which is wrapped around a hand 14 of a patient and having an entertainment device 14 enclosed therein. The entertainment device 14 of the preferred embodiment may be a "CHEMO AMIGO" doll having facial expressions on both sides of the head of the doll, or it may be embodied by one of countless varieties available of similar size for use in the wrap 12. However, other entertainment devices may be provided within wrap 12 such as electronic devices made for various ages of patients. The wrap 12 provides support and protection for an intravenous needle (in this embodiment) inserted into a vein on the back of a patient's hand and an IV tube 18 extends along the patient's arm 17 away from the wrap 12.

Figure 2A:
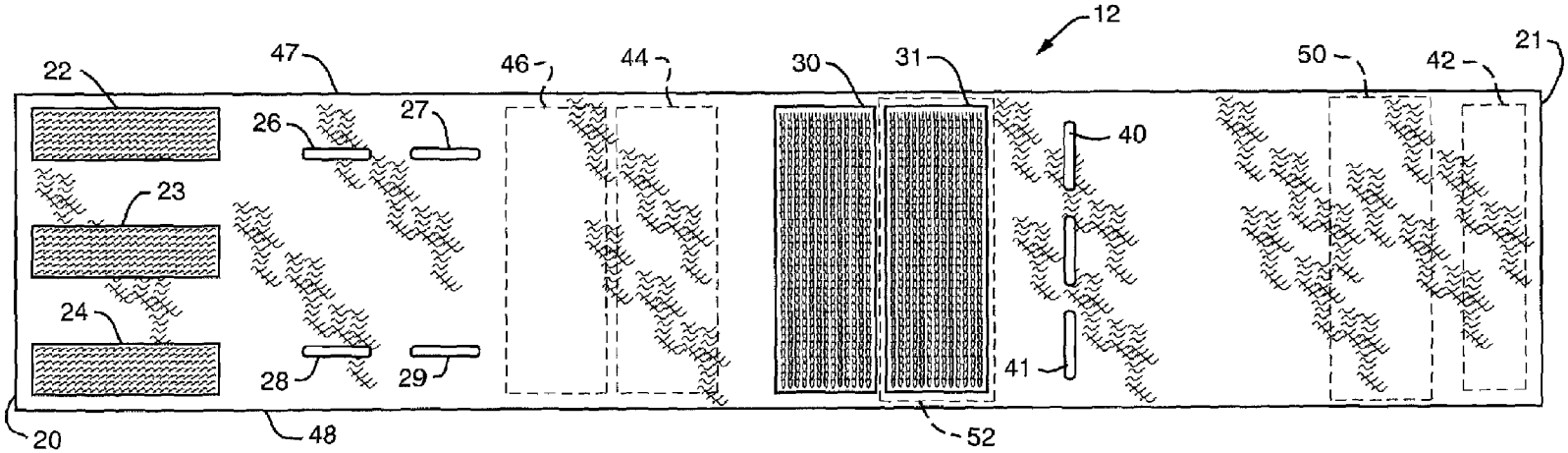
FIG. 2A is a rear elevational view of an elongated wrap of the present invention.
Figure 2B:
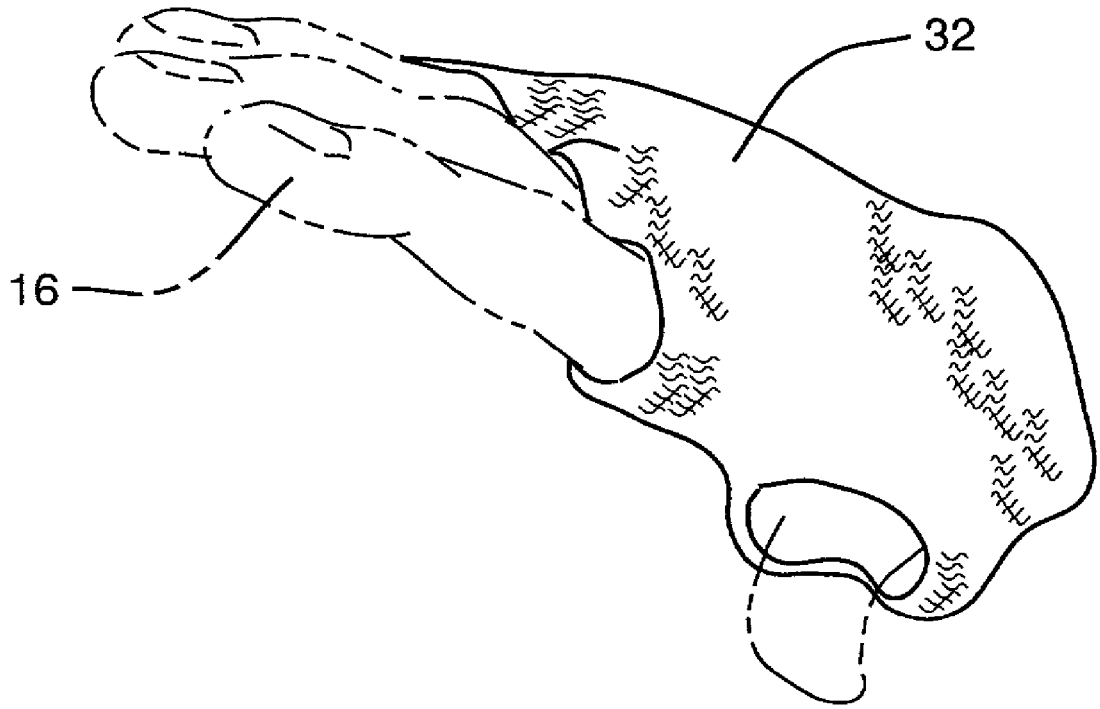
FIG. 2B is a perspective view of a glove for covering the site of an intravenous needle insertion.
Figure 3:
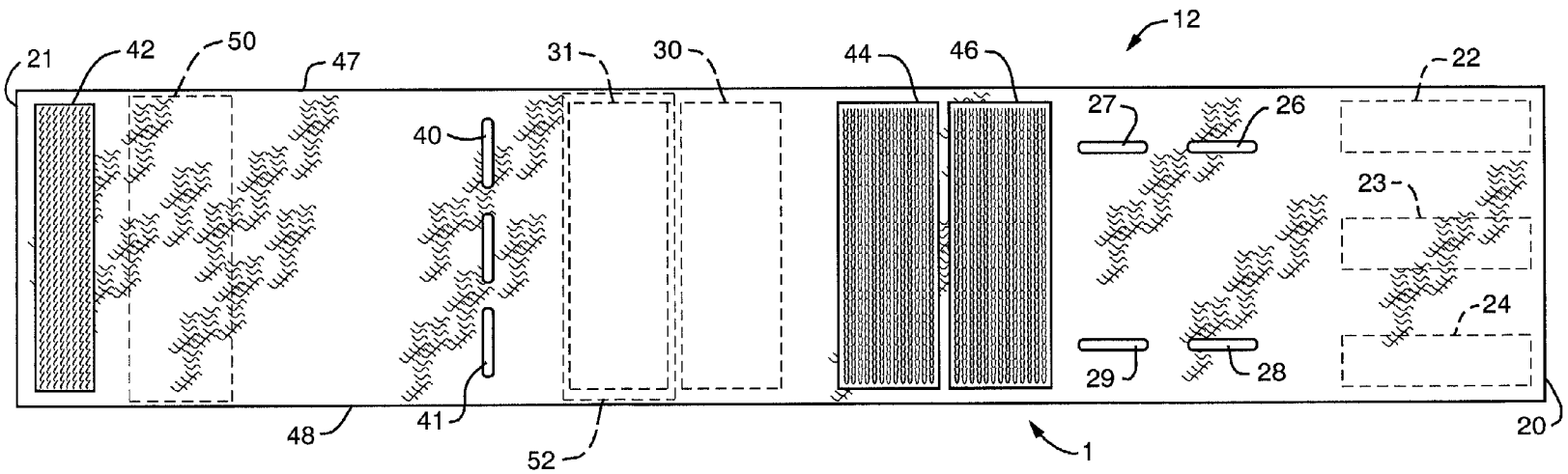
FIG. 3 is a front elevational view of the elongated wrap of FIG. 2.

Referring now to FIG. 2A, FIG. 2B and FIG. 3, FIG. 2A is a rear elevational view of wrap 12 and FIG. 3 is a front elevational view of wrap 12. FIG. 2B is a perspective view of a fingerless glove 32 for wearing on the patient's hand 16 to cover the IV site on the back of the patient's hand. The wrap 12 comprises an elongated fabric having first and second ends 20, 21, respectively, and top and bottom edges 47, 48 respectively. As shown in FIG. 2A, the rear of the wrap 12 comprises three rectangular fastening strips 22, 23, 24 of hook material attached near the first end 20 of the wrap 12, each of the fastening strips 22, 23, 24 positioned horizontally one above the other and equally spaced from each other. These strips 22, 23, 24 may vary in size and shape in accordance with the designer's choice. The fastening strips 22, 23, 24 are stitched or otherwise secured to the rear of the wrap 12. Four elongated, horizontal type openings, 26, 27, 28, 29 are positioned as shown in FIG. 2A to the right of the fastening strips 22, 23, 24. Two of the openings 26 and 27 are positioned closer to top edge 47, above and vertically aligned with openings 28 and 29 which are positioned closer to bottom edge 48. The size of the openings is large enough to permit penetration by the arms of the entertainment doll 14 or components of another entertainment device 14.

Still referring to FIG. 2A and FIG. 2B, two rectangular strips 30, 31 of fibrous loop material are attached to the wrap 12 approximately midway between the right end of hook fastening strips 22, 23, 24 and the second end 21 of the wrap 12. The strips 30, 31 are positioned vertically on the wrap 12 and immediately adjacent to each other. At least two elongated type vertical openings 40, 41 are positioned one above the other adjacent to fastening strip 31 and spaced a short distance away to enable the thumb of a patient to protrude through one of these vertical openings 40 or 41. FIG. 2A shows the glove 32 for insertion of the patients fingers provides protection for the patient's hand 16 and confines an intravenous needle inserted in the back of the hand 16. The glove 32 may be embodied with a very soft pliable fabric such as nylon.

The wrap 12 may be implemented with a soft, pliable, washable, hypo-allergic fabric such as cotton/polyester. The hook-and-loop separable fastening strips may be embodied with the type sold under the trademark Velcro material, and other types of mating fasteners could be used such as snap fasteners, buttons or zippers.

Referring again to FIG. 3, a hook fastening strip 42 is attached adjacent to wrap end 21 in a vertically oriented position. Also, two loop fastening strips 44, 46 are attached to the wrap 12 in a vertically oriented position and adjacent to each other. The loop fastening strips 44, 46 are positioned on the front of wrap 12 adjacent to the loop fastening strips 30, 31 attached on the front of the wrap 12. The spacing between the strip 44, and strip 30 may vary depending on the size of the patient's hand and the length of the wrap. Typical overall dimensions of wrap 12 are as follows: the length of wrap 12 from end 20 to end 22 may be 24 inches and the height of wrap 20 from the top edge 47 to the bottom edge 48 may be 6 inches. Other size wraps may be embodied to accommodate the various hand sizes of a patient or varying entertainment device sizes.

Still referring to FIG. 3, two pockets 50, 52 are provided on the front of wrap 12 for insertion of a stiffening insert made of wood, plastic or other rigid material. The stiffening insert provides for protection of the IV site on the hand of the patient. Pocket 50 is positioned and attached to wrap 12 adjacent to fastening strip 42 and has an opening at one end for insertion of a stiffener (not shown). Pocket 52 is positioned and attached on the front of wrap 12 opposite the loop strip 31 on the rear side of wrap 12 and has an opening at one end for insertion of a similar stiffener (not shown). The pockets 50, 52 may be embodied by the same material as the wrap 12.

Figure 4:
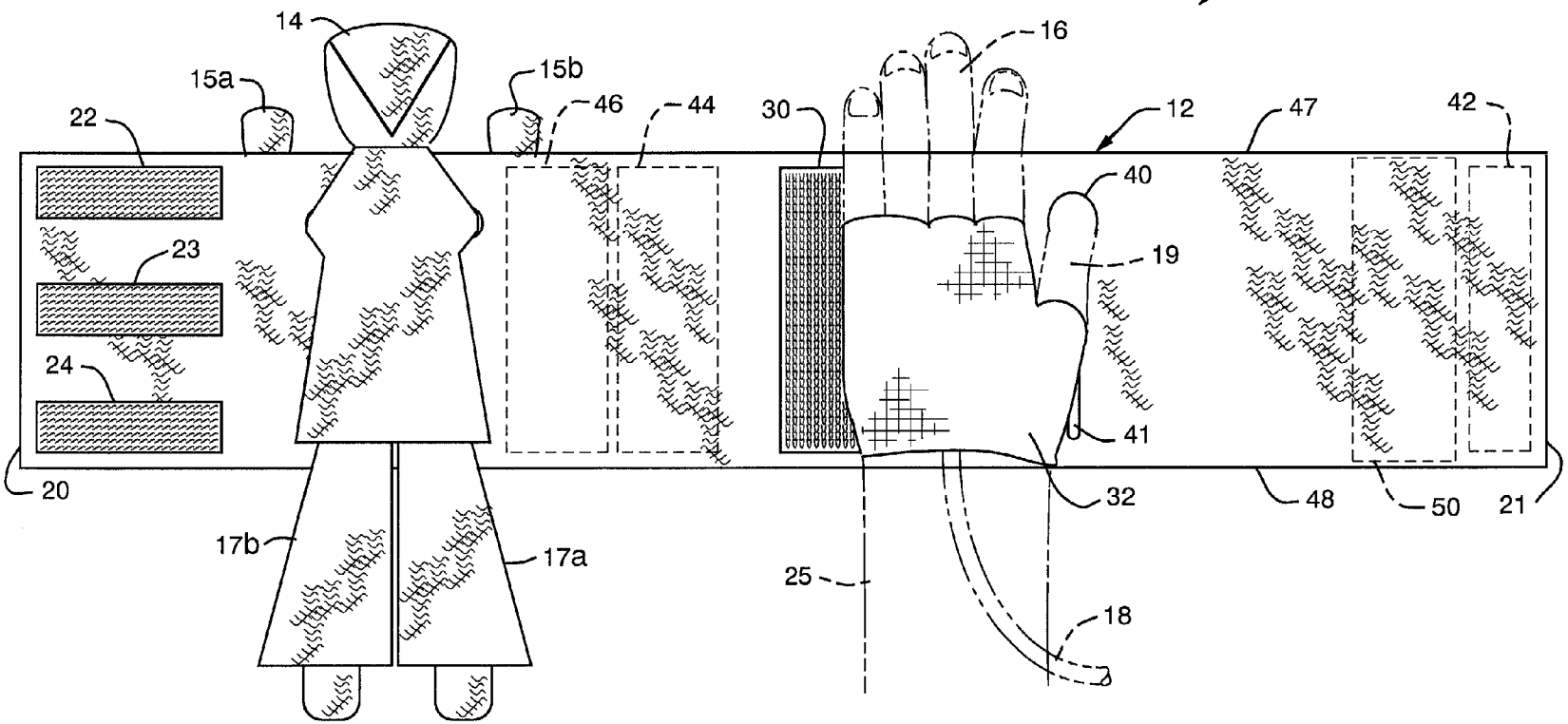
FIG. 4 shows a doll and a simulated hand inserted in the wrap of FIG. 2.

Referring to FIG. 4, the rear elevational view of FIG. 2 of the wrap 12 is shown with a doll 14 having arms 15*a* and 15*b* inserted through openings 26 and 27, respectively, and the hand 16 of a patient resting partially on fastening strip 30 and resting fully on fastening strip 31 with the thumb of the patient inserted through opening 40. The fingers of the hand 16 extend through glove 32 which covers the IV site on the back of the hand 16.

Figure 5:
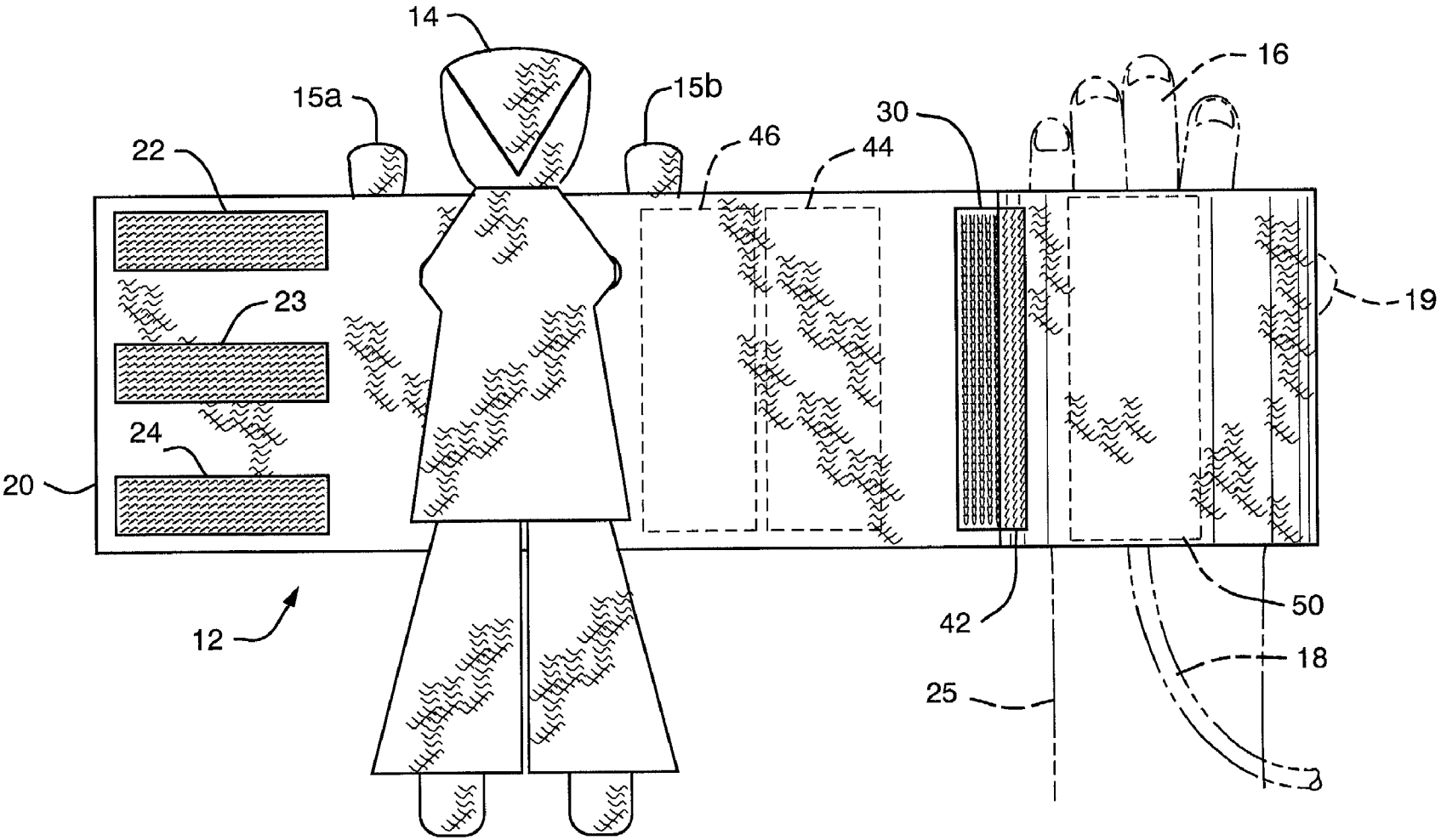
FIG. 5 shows the wrap illustrated in FIG. 4 at the first step of wrapping around a wearer's hand having a first fastening strip becoming in contact with a second fastening strip.
Figure 6:
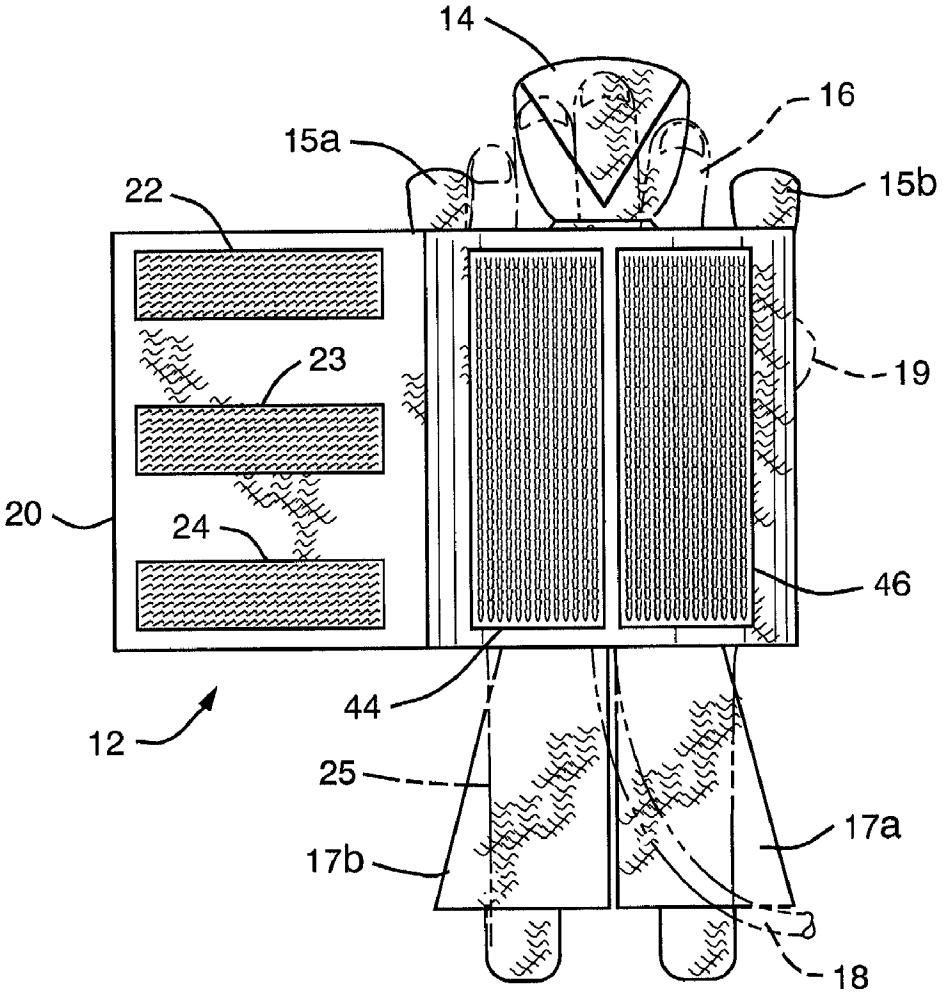
FIG. 6 shows the wrap of FIG. 5 at the second step of the wrapping after being rolled 360 degrees placing the hand behind the doll and showing the remaining fasteners to secure the wrap.

Referring now to FIG. 5 and FIG. 6, FIG. 5 shows the wrap 12 after the first step in the wrapping of the hand 16 by folding the second end 21 of the wrap 12 over the hand 16 bringing the hook fastening strip 42 in contact with the loop fastening strip 30. FIG. 6 shows the second step of the wrapping after the hand 16 has been rotated 360 degrees towards the doll 14 from its position in FIG. 5 resulting in the palm of the hand 16 facing the back of the doll 14 (see FIG. 1). The first end 20 remains to be folded over the back of the doll 14 and hand 16 whereby hook strips 22, 23, 24 are fastened to loop strips 44, 46.

Figure 7:
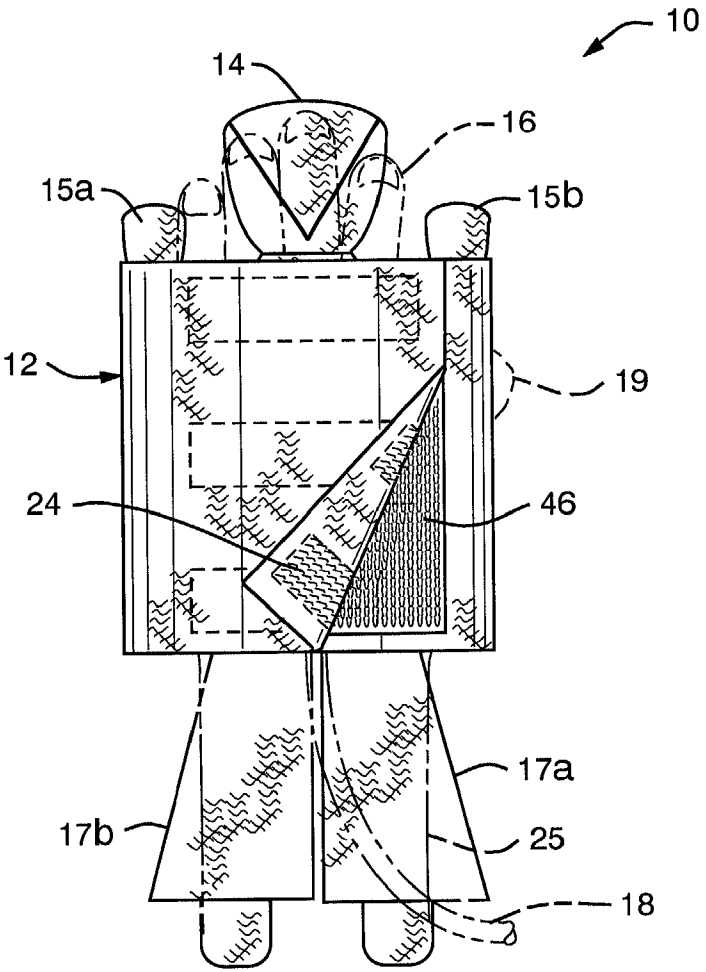
FIG. 7 is a rear elevational view of the wrap of FIG. 6 at the third step of securing the wrap by the remaining fastening strips shown on the first end in FIG. 6.

Referring to FIG. 7, third and final step of employing the wrap 12 around the hand 16 and the doll 14 shows the first end 20 of wrap 12 with hook strips 22, 23, 24 folded over the loop strips 30, 31 and wrap 12 is shown being closed-up and secured by the hook and loop strips around the patient's hand 16 and doll 14.

Alternate Embodiment

Figure 8:
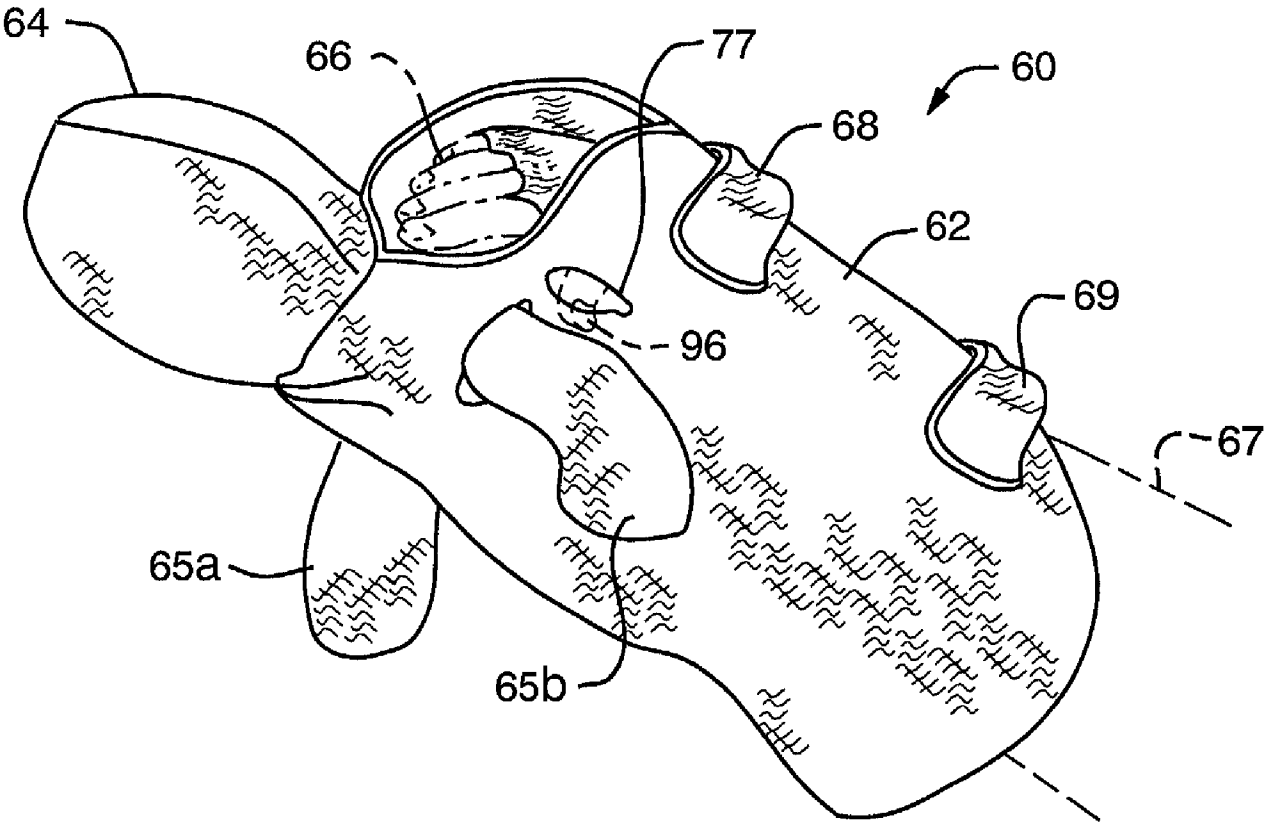
FIG. 8 is a perspective view of an alternate embodiment of the invention of an intravenous protector wrap for a hand of a baby including an entertainment doll.

Referring now to FIG. 8, a perspective view is shown of an alternate embodiment of the invention of an intravenous protector wrap assembly 60 for a hand, limb or foot of a baby and an entertainment doll 64. A "CHEMO AMIGO" doll may be used having a facial expression on both sides of the head of the doll for entertainment purposes or any doll may be used of a suitable size proportional to the size of the baby's hand and the length of the wrap 62.

Figure 9:
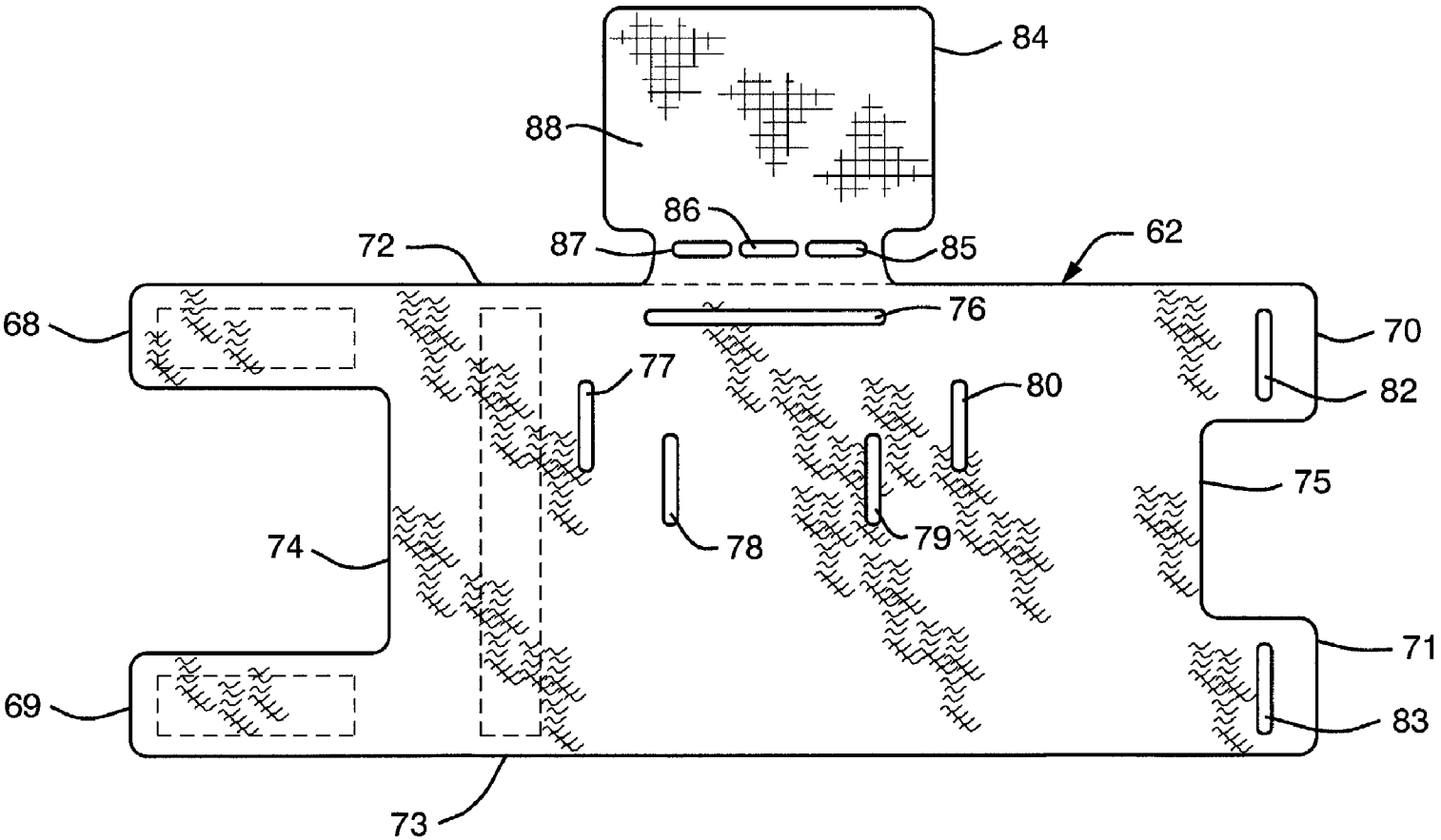
FIG. 9 is a rear elevational view of a baby wrap of the alternate embodiment of the invention.
Figure 10:
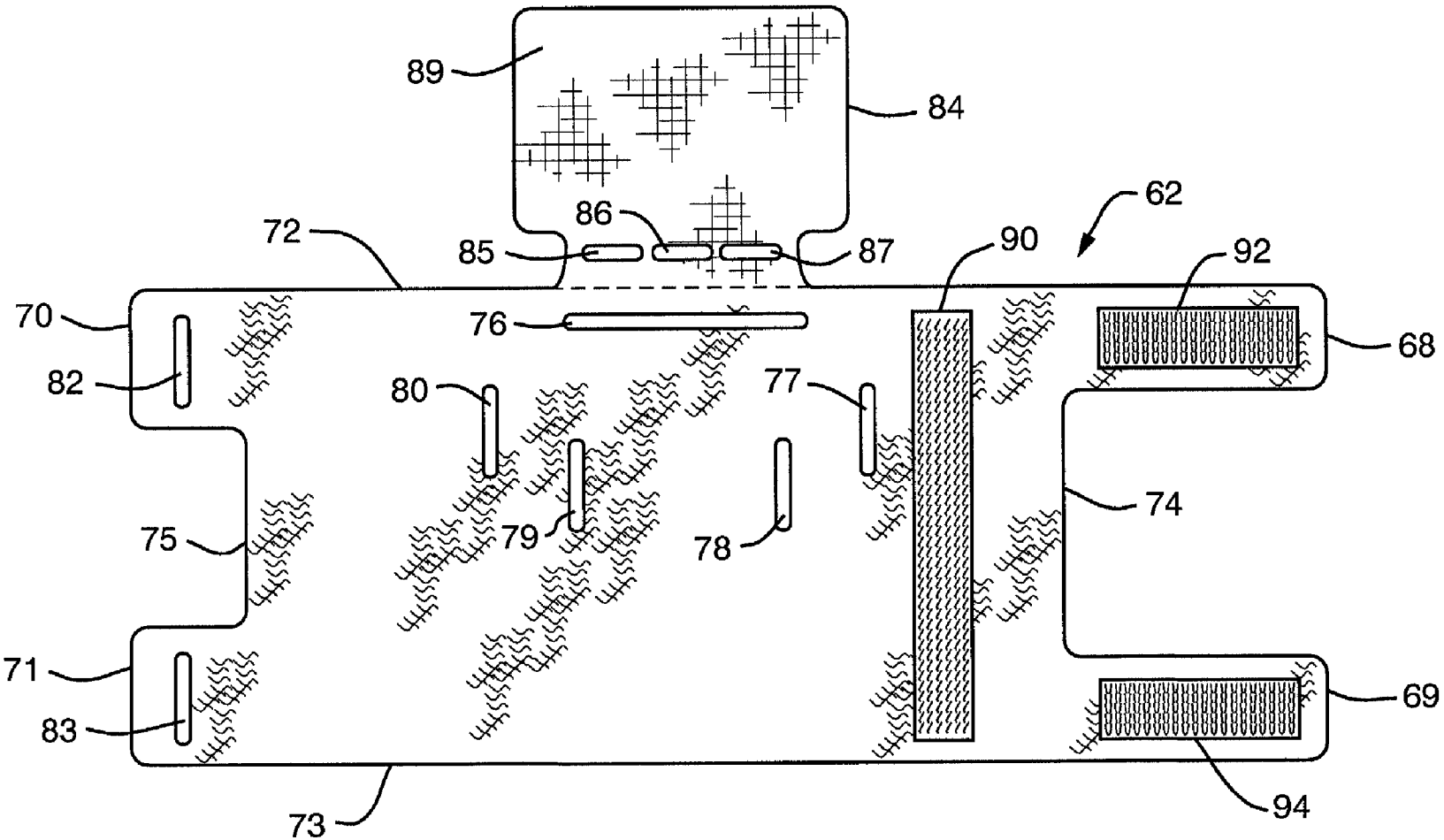
FIG. 10 is a front elevational view of the baby wrap of the alternate embodiment of the invention.

Referring to FIG. 9 and FIG. 10, FIG. 9 is a front elevational view of the baby wrap 62, and FIG. 10 is a rear view of the baby wrap 62. The baby wrap 62 comprises a fabric having first and second ends 74, 75, respectively, and top and bottom edges 72, 73 respectively. The top edge 72 extends beyond first end 74 forming a first closure tab 68; likewise, the bottom edge 73 extends beyond first end 74 forming a second closure tab 69 at the first end 75. The top edge 72 extends a predetermined distance beyond the second end 75 forming a receiving tab 70 having an opening 82 for receiving the first closure tab 68; likewise, the bottom edge 73 extends beyond second end 75 the same predetermined distance as the receiving tab 70, forming a second receiving tab 71 having an opening 83 for receiving the second closure tab 69, such predetermined distance being less than the length of first and second closure tabs 68 and 69, and sufficient to cooperate in providing a secure closure of the wrap 62 around a baby's hand.

Positioned within a center area of the baby wrap 62 are four narrow openings 77, 78, 79, 80 oriented parallel to the ends 74, 75. Two of the openings 78 and 79 are located within openings 77 and 80 and below an imaginary line connecting the center of openings 77 and 80. Openings 78, 79 are for receiving the arms 65*a*, 65*b* of the doll 64 shown in FIG. 8 and openings 77 and 80 are for receiving a thumb 67 of a baby's hand 66. An elongated opening 76 is positioned adjacent and parallel to top edge 72 and the ends of opening 76 extend above openings 78, 79 for receiving a head of the doll 64. Extending above and attached to the top edge 72 is a soft fabric flap 84 having three finger holes 85, 86, 87 placed adjacent to each other parallel to the elongated opening 76. The flap 84 extends a distance above the top edge 72 whereby, when it is folded down towards bottom edge 73, it will extend approximately three-quarters of the distance between the top edge 72 and the bottom edge 73 sufficient to cover the back portion of the hand 66 of the baby. Three fingers of the baby patient are inserted in openings 85, 86, 87 prior to folding flap 84 over the back of the baby patient's hand where an intravenous needle (not shown) is inserted into a vein.

Referring now to FIG. 10, the front of the baby wrap shows fastening strips 92, 94 which are attached to first closure tab 68 and second closure tab 69, respectively. The fastening strips 92, 94 are made of a fibrous loop material as described above. A rectangular fastening strip 90 made of hook material has its longer dimension positioned between top edge 72 and bottom edge 73. The loop side of fastening strip 90 runs parallel and between opening 77 and wrap end 74. The exact spacing is variable depending on the length of the wrap 62 and closure tabs 68, 69 in order to secure a particular size wrap around the baby's hand 66 and entertainment doll 64.

Figure 11:
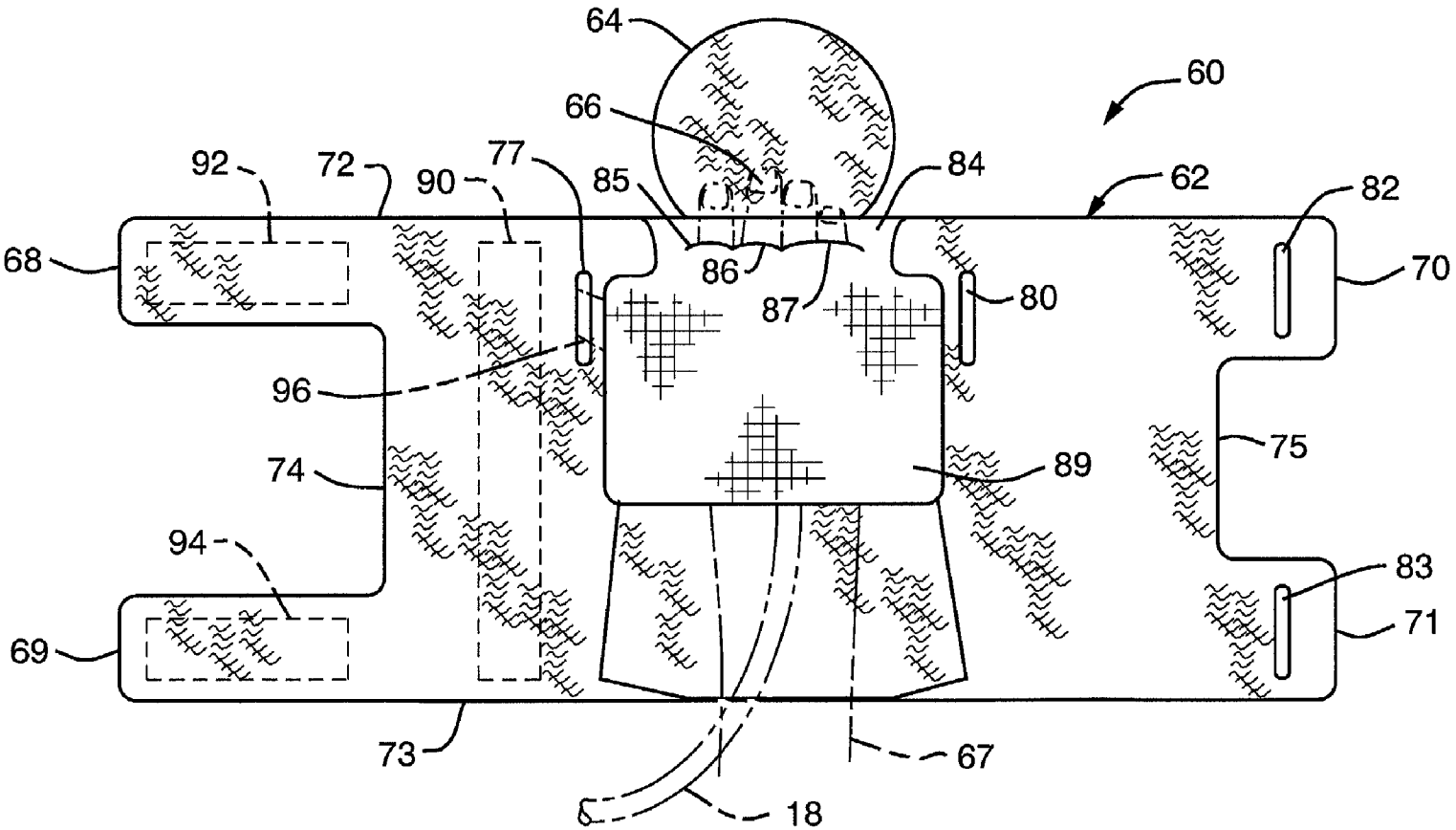
FIG. 11 is a front view of the alternate embodiment baby wrap of FIG. 9 showing the arms of the doll inserted in the baby wrap and a hand protector folded over a baby's hand resting on the back of the doll.

Referring to FIG. 9 and FIG. 11, FIG. 11 shows the rear view of the baby wrap 62 having the arms 65*a*, 65*b* of the doll 64 inserted into openings 78 and 79 to extend out in front of the doll 64, and the baby's hand placed on the back of the doll 64. The thumb 96 of the baby's hand 66 protrudes through opening 77 and the intravenous site protector flap 84 is turned down over the back of the baby's hand 66. An intravenous tube 18 extends along the patient's arm 67 away from the wrap 62.

Figure 12:
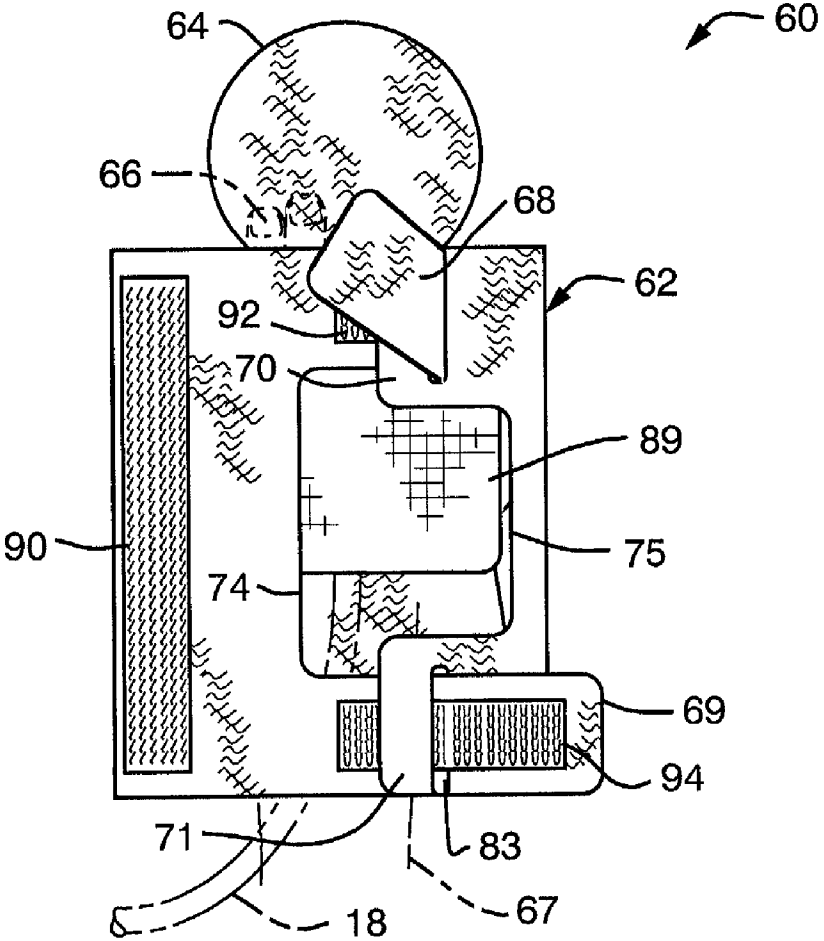
FIG. 12 shows the baby wrap of FIG. 11 being folded around the baby's hand to secure the baby wrap around the baby's hand and the doll.

Referring now to FIG. 12, the baby wrap 62 is shown being secured around the baby's hand 66. The first closure tab 68 is inserted through the opening 82 of the receiving tab 70 and folded back over itself for attaching to an upper portion of fastening loop strip 90. The second closure tab 69 is inserted through the opening 83 of receiving tab 71 and then it is folded over itself and attached to a lower portion of fastening loop strip 90. Before attachment to the closure tabs 68, 69 pull the wrap end 75 is pulled toward wrap end 74 in order to tightly secure the wrap around the baby's hand 66.

Figure 13:
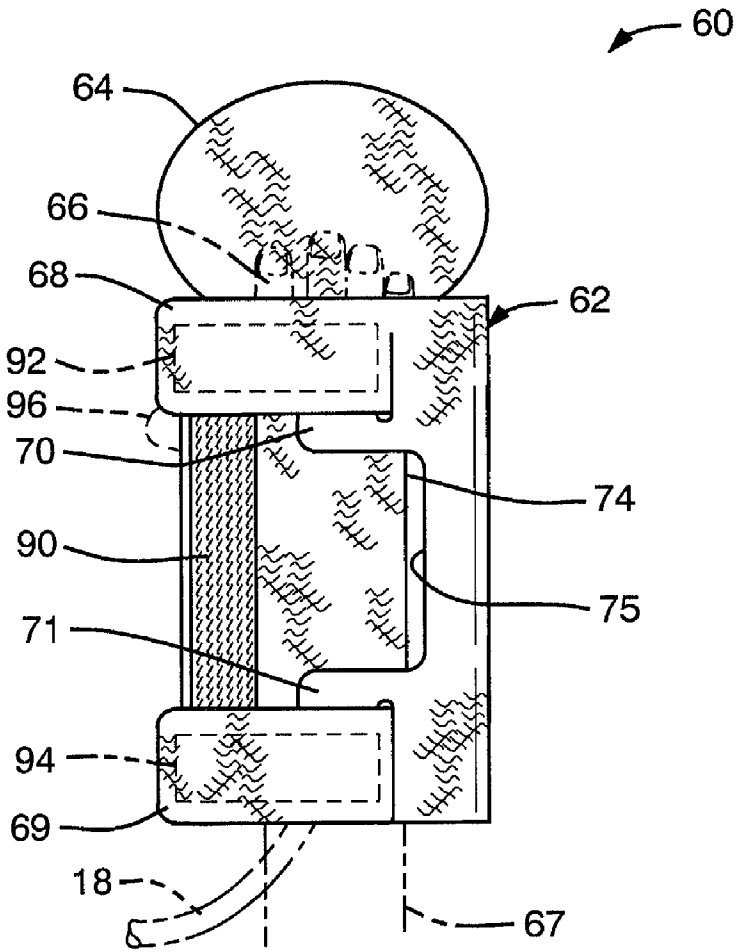
FIG. 13 shows the baby protector wrap embodiment of FIGS. 11 and 12 secured around a baby's hand along with an entertainment doll.

Referring to FIG. 13, the protector baby wrap assembly 60 is shown with the baby wrap 62 tightly secured around the baby's hand 66 having an intravenous site on the back of the hand with the intravenous tube 18 extending therefrom. The closure tabs 68 and 69 are shown attached to fastening strip 90.

The baby wrap 62 fabric may be embodied with polyester, cotton/polyester material or any washable fabric, preferably silky. The folding flap 84 may be embodied with polyester, cotton/polyester material. As described for the wrap 12 of the preferred embodiment, the hook-and-loop separable fastening strips 90, 92, 94 may be embodied with the type sold under the trademark Velcro material and other types of mating fasteners could be used such as snap fasteners, buttons or zippers.

Typical overall dimensions of the baby wrap 62 are as follows: the length of wrap 62 from the end of first closure tab 68 to the end of receiving tab 70 may be 9.5 inches and the height of baby wrap 62 from the top edge 72 to the bottom edge 73 may be 4 inches. The flap 84 may be 2.5 inches wide and 2 inches high. Other size wraps may be embodied to accommodate varying sizes of entertainment devices.

This invention has been disclosed in terms of certain embodiments. It will be apparent that many modifications can be made to the disclosed apparatus without departing from the invention. Therefore, it is the intent of the appended claims to cover all such variations and modifications as come within the true spirit and scope of this invention.

What is claimed as new and desired to be secured by Letters Patent of the United States is:

1. A protective wrap for covering an intravenous site on a person including an entertainment device comprising:

a rear side of said wrap comprises a first area for fastening material adjacent to a first end;

a plurality of first openings adjacent to said first area of fastening material for inserting a portion of an entertainment device through at least one of said first openings, said entertainment device being positioned on said rear side over said plurality of first openings;

a second area of fastening material positioned on said wrap approximately midway between said first end and a second end of said rear side of said wrap;

a plurality of second openings vertically arranged adjacent to said second area of fastening material and spaced apart from said second end of said wrap;

one of said plurality of second openings capable of receiving a thumb of said person, and a portion of said second area of fastening material adjacent to said plurality of vertically arranged second openings provides for receiving a palm of a hand of said person to rest thereon;

a front side of said wrap comprises a third area of fastening material adjacent to said second end;

said front side of said wrap comprises a fourth area of fastening material positioned approximately midway between said second area of fastening material on said rear side of said wrap and said plurality of said first openings;

said second end of said wrap being capable of being folded over a back portion of said hand and said third area of fastening material on said front side of said protective wrap attaches to said second area of fastening material on said rear side of said wrap;

said second end of said wrap being capable of being turned 360 degrees in the direction of said first end whereby said fourth area of fastening material on said front side of said wrap faces outwardly away from said hand; and said first end of said wrap having said first area of fastening material on said rear side of said wrap attaches to said outwardly facing fourth area of fastening material on said front side of said wrap.

2. The protective wrap as recited in claim 1 wherein said entertainment device comprises a doll, said arms of said doll extending through a pair of said plurality of first openings.

3. The protective wrap as recited in claim 1 wherein said wrap includes a fingerless glove for covering said hand having said intravenous site prior to being wrapped by said protective wrap.

* * * * *